United States Patent [19]

Yamamoto et al.

[11] Patent Number: 4,667,611

[45] Date of Patent: May 26, 1987

[54] SEWING DEVICE FOR USE IN MULTI-NEEDLE SEWING MACHINE

[75] Inventors: Masaya Yamamoto; Kenji Ikeda, both of Osaka, Japan

[73] Assignee: Morimoto Mfg. Co., Ltd., Osaka, Japan

[21] Appl. No.: 857,923

[22] Filed: Apr. 30, 1986

Related U.S. Application Data

[63] Continuation-in-part of Ser. No. 675,820, Nov. 28, 1984, abandoned.

[30] Foreign Application Priority Data

Jul. 31, 1984 [JP] Japan ..... 59-162056

[51] Int. Cl.[4] ..... D05B 1/10

[52] U.S. Cl. ..... 112/166; 112/199

[58] Field of Search ..... 112/166, 165, 167, 163, 112/199, 226, 235, 260

[56] References Cited

U.S. PATENT DOCUMENTS

| | | | |
|---|---|---|---|
| 24,892 | 7/1859 | Singer | 112/226 |
| 190,475 | 5/1877 | Dawson | 112/167 |
| 1,016,462 | 2/1912 | Weis | 112/235 |
| 1,118,574 | 11/1914 | Onderdonk | 112/166 |
| 1,605,385 | 11/1926 | Bebel | 112/167 |
| 2,384,454 | 9/1945 | Cosentino | 112/235 |
| 2,688,293 | 9/1954 | Hayes et al. | 112/199 |
| 2,812,735 | 11/1957 | Nelson | 112/199 |

FOREIGN PATENT DOCUMENTS

| | | | |
|---|---|---|---|
| 423110 | 12/1925 | Fed. Rep. of Germany | 112/199 |

*Primary Examiner*—H. Hampton Hunter

*Attorney, Agent, or Firm*—Koda and Androlia

[57] ABSTRACT

A sewing device for use in multi-needle sewing machine comprising a plurality of needles, presser feet, throat plates, feed dogs and loopers arranged in parallel with each other, and optionally a plurality of spreaders arranged in parallel with each other. Each needle holder on which each needle is set is supported on a needle bed in a manner slidable in the direction of the row of needles and is fixed to any slided position by tightening each set screw. Each interval between needles are changed by changing the fixing position of each needle holder. Each presser foot, throat plate, feed dog, looper and spreader are respectively held by the presser foot holder, throat plate holder, feed dog holder, looper holder and spreader holder in a slidable manner along the direction parallel with the row of needles, and are fixed to the required positions corresponding to each of changed needle interval.

12 Claims, 25 Drawing Figures

5
6
7
8
30
31
32
34
34a
35
35a
35b
36
37
38
39
40
41
42
43
44
50
51
52
53
54
56
57
58
110
120
130
150

SEWING DEVICE FOR USE IN MULTI-NEEDLE SEWING MACHINE

This is a continuation-in-part application of Ser. No. 675,820 filed Nov. 28, 1984 now abandoned.

BACKGROUND OF THE INVENTION (1) Field of the Invention

This invention relates to a sewing device for use in multi-needle sewing machine, and more particularly to a sewing device comprising a needle unit with a plurality of needles, a presser foot unit with a plurality of presser feet, a throat plate unit with a plurality of throat plates, a feed dog unit with a plurality of feed dogs, and a looper unit with a plurality of loopers.

(2) Prior Art

In the known sewing device for use in multi-needle sewing machine, an interval between presser feet, an interval between throat plates, and interval between feed dogs and an interval between loopers are respectively set according to each interval between needles (hereinafter called as "needle interval"), and said needle interval and each of said intervals are not variable. Accordingly, when necessary to change the needle interval, it is required to replace each component or unit such as needle bed, presser foot unit according to a new specification taking the place of the original specification.

Needless to say, it is quite uneconomical for an user to have varieties of components or units such as needle bed, presser foot unit always available or ready according to the difference of the needle interval for which replacement is supposed to be necessary. Further, it is not so easy to keep those components or units well-maintained even when they are out of use. Furthermore, it is neither efficient nor easy to change the needle interval by replacing each component or unit every time of such change.

From the standpoint of a manufacturer, in order to meet as soon as possible the request from user, it is necessary for them to manufacture every specification of components and units and to assort those components in the store house.

Moreover, since each component or unit such as needle bed, presser foot is not a so-called general purpose article but and article for exclusive use which is not suitable for mass production and requires rather high accuracy and high cost in their production, it is difficult to provide said component or unit at moderate price. Thus there exists a problem in that for both user and manufacturer the financial burden is too heavy.

SUMMARY OF THE INVENTION

In accordance with this invention, a novel sewing device for use in multi-needle sewing machine is provided which avoids all of the above-discussed problems and in which each interval between needles is optionally varied or changed. Thus, in the sewing device of this invention, each needle holder for holding each needle is supported on the needle bed in a manner slidable in the direction of the arranged row of needles, and is fixed to any slided position by a fixing means or a means for fixation, thereby the needle interval being freely variable and adjustable.

Further, each presser foot, throat plate, feed dog and looper are supported or held respectively on each presser foot holder, throat plate holder, feed dog holder and looper holder in a manner slidable in the direction of the row of needles, and are fixed to any slided positions by a fixing means, thereby each interval between the presser feet, that between the throat plates, that between the feed dogs and that between the loopers being variable and adjustable according to the changed needle interval.

In the sewing device requiring a spreader unit with a plurality of spreaders, each spreader is held on the spreader holder in a manner slidable in the direction of the row of needles, and each spreader is fixed to any slided position by a fixing means, thereby each interval between spreaders being variable and adjustable according to the changed needle interval.

OBJECTS AND ADVANTAGES OF THE INVENTION

Accordingly, it is an object of this invention to provide a sewing device for use in multi-needle sewing machine in which the needle interval can be changed according to the manner of sewing without replacing such component as needle bed.

It is a further object of this invention to provide a sewing device for use in multi-needle sewing machine in which the change of the needle interval is easily and efficiently carried out without such troublesome work as removing each component from the machine body for the replacement with a new component, and by which the efficiency in various sewing operations using one multi-needle sewing machine is greatly improved.

It is yet another object of this invention to provide a sewing device for use in multi-needle sewing machine in which such component as needle bed, presser foot unit has a generality or versatility of adaptable to varieties of needle intervals, thereby the finantial burden to both user and manufacturer being greatly decreased.

Other objects and advantages of this invention will become apparent from the detailed description to follow in conjunction with the accompanying drawings.

BRIEF DESCRIPTION OF THE DRAWINGS

In the accompanying drawings forming a part of this application and in which like parts are designated reference numerals throughout the same.

DESCRIPTION OF THE PREFERRED EMBODIMENTS

Referring now to the accompanying drawings, several embodiments are described hereunder.

Figure 1:
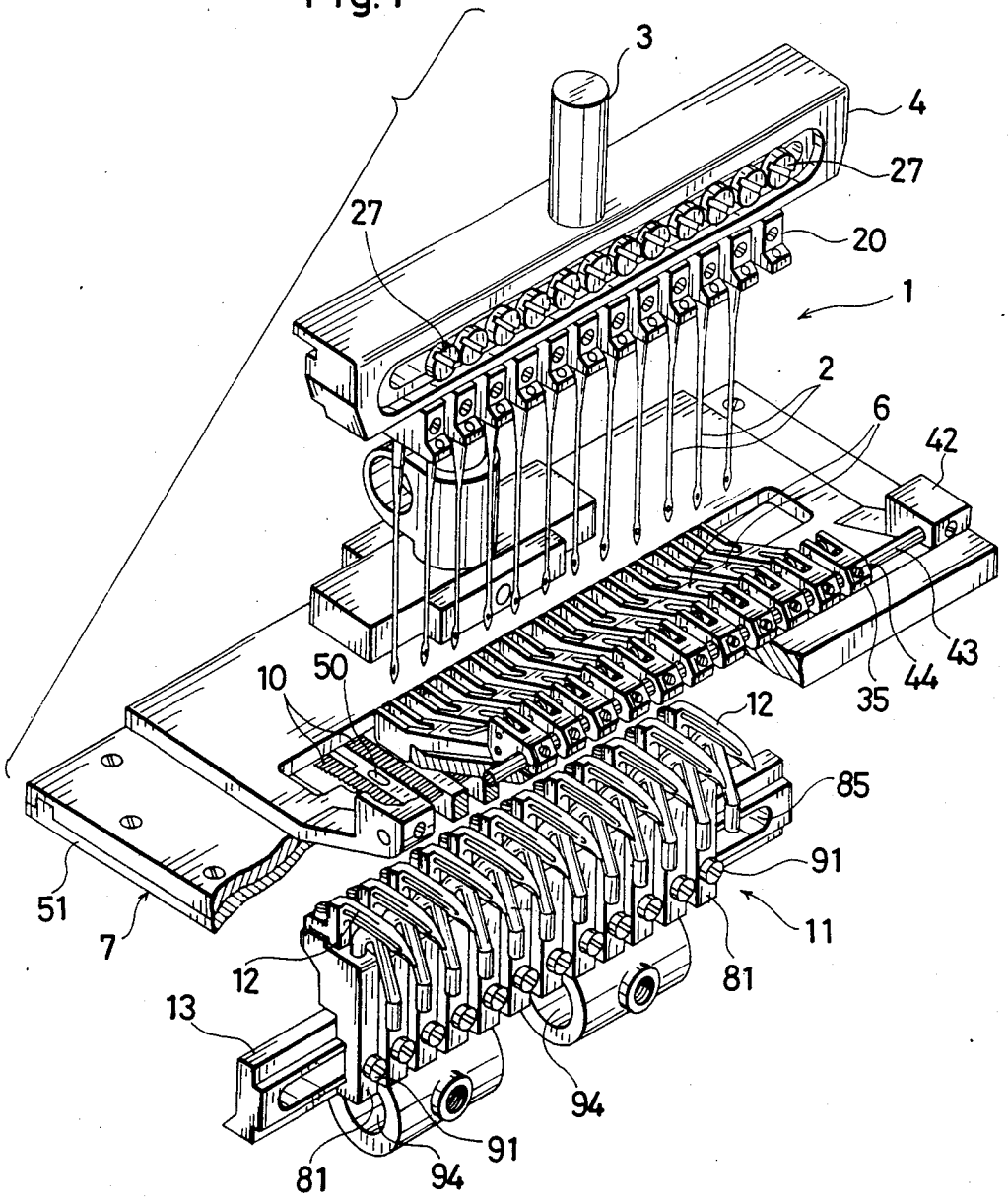
FIG. 1 is a perspective view of a sewing device illustrating an embodiment of this invention.

In FIG. 1 showing a perspective view of a sewing device for use in a multi-needle double chain stitch sewing machine, said sewing device comprises a needle unit 1 with a plurality of needles 2 arranged in a row, a presser foot unit with a plurality of presser feet 6 arranged in a row, a throat plate unit 7 with a plurality of throat plates 8 arranged in a row, a feed dog 9 unit with a plurality of feed dogs 10, and a looper unit 11 with a plurality of loopers 12.

Figure 2:
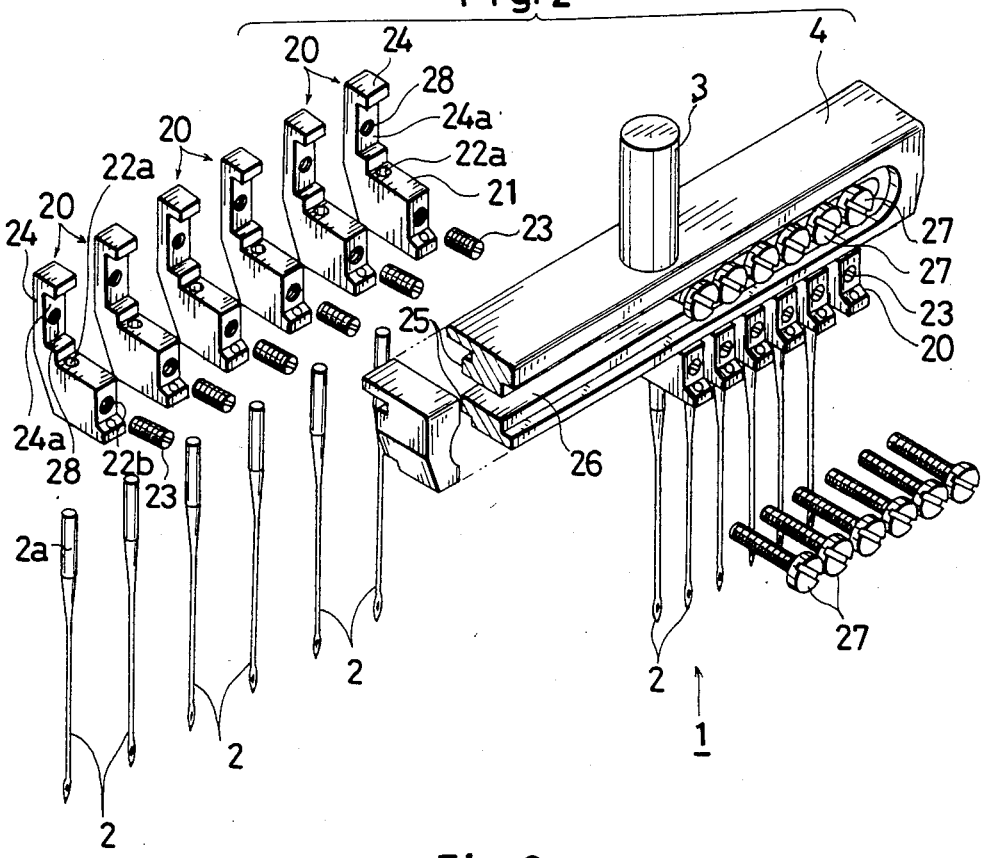
FIG. 2 is a partially exploded perspective view of a needle unit in the same embodiment as FIG. 1.

As illustrated in FIG. 2, said needle unit 1 comprises the needles 2 each being set on a L-shaped needle holder 20, and a needle bed 4 fixed to the lower end of a needle bar 3 and on which each needle holder is supported. Said needle bed 4 extends in the direction parallel with the row of the needles 1, and a rail-like projecting portion 25 is formed on the back side of the needle bed 4 along the longitudinal direction thereof.

In each needle holder 20, a needle setting hole 22*a* passing through in the vertical direction thereof and a tapped hole 22*b* intersecting said needle setting hole 22*a* are respectively formed on the base portion 21 of the holder 20, and a recess 24*a* is formed on the front portion of the standing part of the holder 20, said recess 24*a* being engageable with said projecting portion 25 in a manner slidable along the longitudinal direction of the projecting portion 25 of the needle bed 4.

Each needle 2 is set on the needle holder 20 by inserting the base portion 2*a* into the needle setting hole 22*a* of the holder 20 and pressing the inserted portion 2*a* by presser screw 23 screwed into the tapped hole 22*b*. Each needle holder 20 is supported on the needle bed 4 in a manner slidable in the longitudinal direction of the bed 4, i.e., in the direction of the row of needles by engaging the recess 24*a* of the holder 20 with the projecting portion 25 of the bed 4.

Each needle holder 20 is fixed to the needle bed 4 by a means for fixation or a fixing means. More particularly a lengthwise hole 26 extending along the longitudinal direction of the needle bed 4 and passing through the needle bed 4 in the transversal direction thereof is formed in the center of the projecting portion 25, each set screw 27 inserted in said hole 26 from the front side of the needle bed 4 is screwed into the tapped hole 28 which is formed on the standing portion 24 of each holder 20 supported on the bed 4, and by tightening each set screw 27 each needle holder 20 can be fixed to any slided position. In this connection, said lengthwise hole 26 has a vertical distance or width not passing through the head of the set screw 27.

Figure 3:
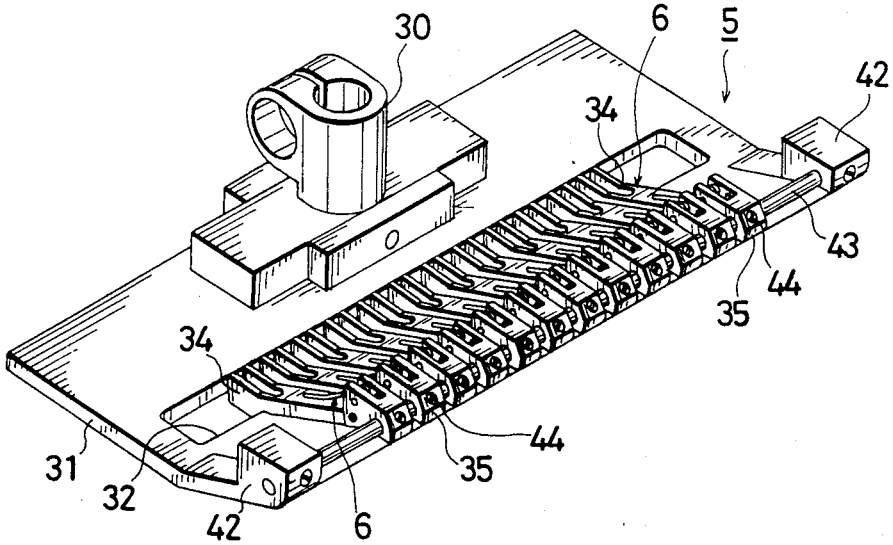
FIG. 3 is a perspective view of a presser foot unit in the same embodiment.

As illustrated in FIG. 3, in the presser foot unit 5, a rectangular presser foot holder 31 extending along the direction of the row of needles and of which front end portion is lightly bent upward is mounted on the lower end portion of a presser bar (not illustrated) moving up and down by operating a lever through a bracket 30 fixed to the upper side of the presser foot holder 31, and a plurality of presser feet 6 are held on the holder 31 along the longitudinal direction thereof. A pair of projecting holding parts 42, 42 are provided on the front edge portion of the presser foot holder 31, a rod 43 is bridged between said both holding parts 42, 42 and an engaging groove 32 extending in the longitudinal direction is formed nearly in the center of the presser foot holder 31.

Figures 4, 5:
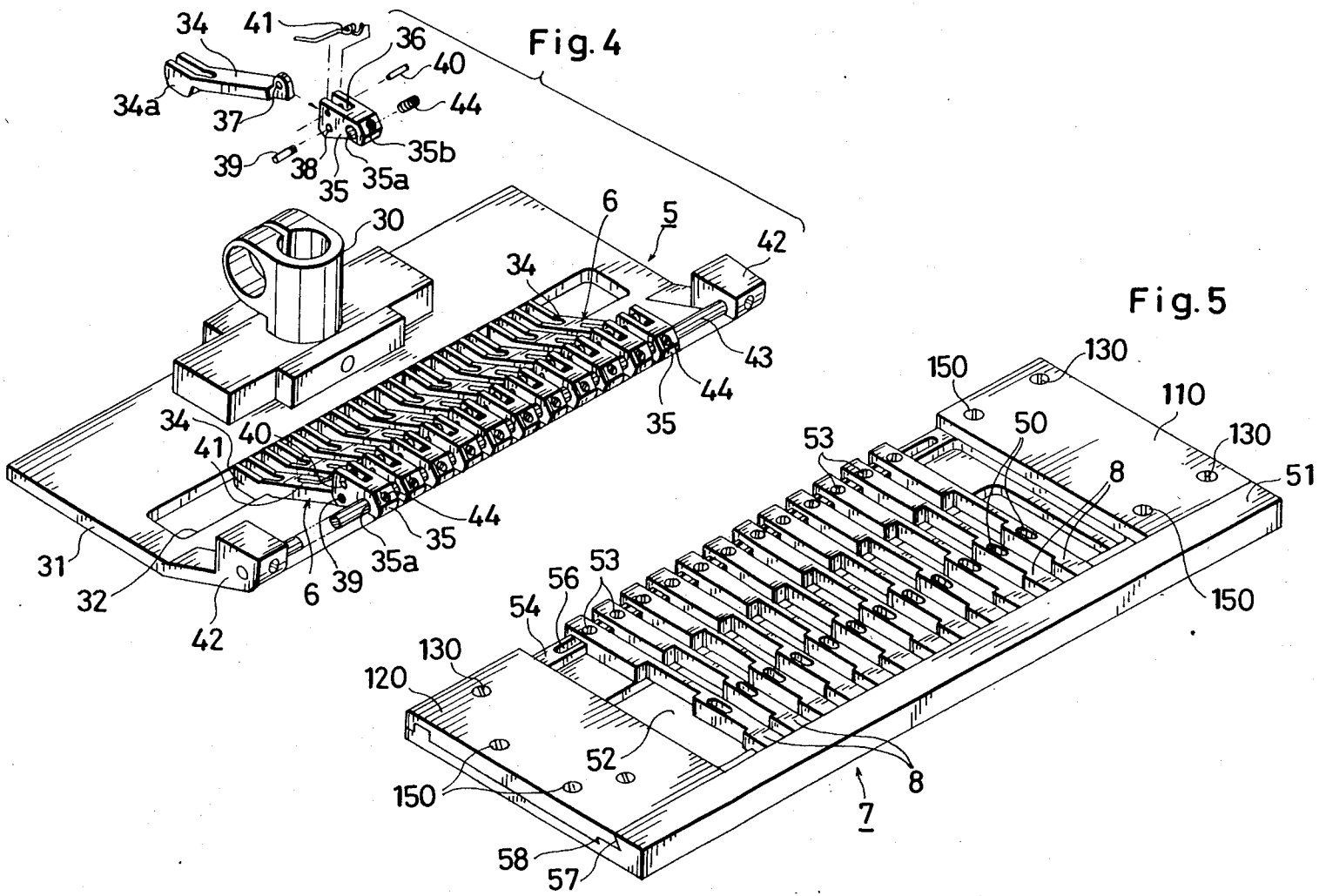
Fig. 4 is a partially exploded perspective view of the same presser foot unit as FIG. 3.
FIG. 5 is a perspective view of a throat plate unit in the same embodiment.

Each of said presser feet comprises an arm 34 and a base 35 as illustrated in FIG. 4, and the arm 34 and the base 35 is connected with each other so as to oscillate vertically on the pin 39 by inserting the front end portion of the arm 34 into the branched portion 36 of the rear end portion of the base 35 and by screwing the pin 39 into a hole 37 of the arm 34 and a hole 38 of the branched portion 36. The arm 34 is urged downward in relation to the base 35 by retaining one end of a spring 41 supported by a pin 40 which is mounted on said branched portion 36 on to the base 35 and by pressing the other end of the spring 41 to upper side of the arm 34.

Each presser foot 6 is held on the presser foot holder 31 in a manner slidable along the direction parallel with the row of needles by inserting the rod 43 into a through hole 35*a* provided on the front end portion of the base 35 and by engaging a branched portion 34*a* of the rear end portion of the arm 34 with the groove 32 of the presser foot holder.

Each presser foot 6 is fixed to the presser foot holder 31 by a presser foot fixing means. More particularly a tapped hole 35*b* which intersects the through hole 35*a* is formed on the front end portion of the base 35 of each presser foot 6, and by tightening a set screw 44 screwed in said tapped hole 35*a* so as to be pressed onto the rod 43, each presser foot 6 is fixed to any slided position.

Figure 6:
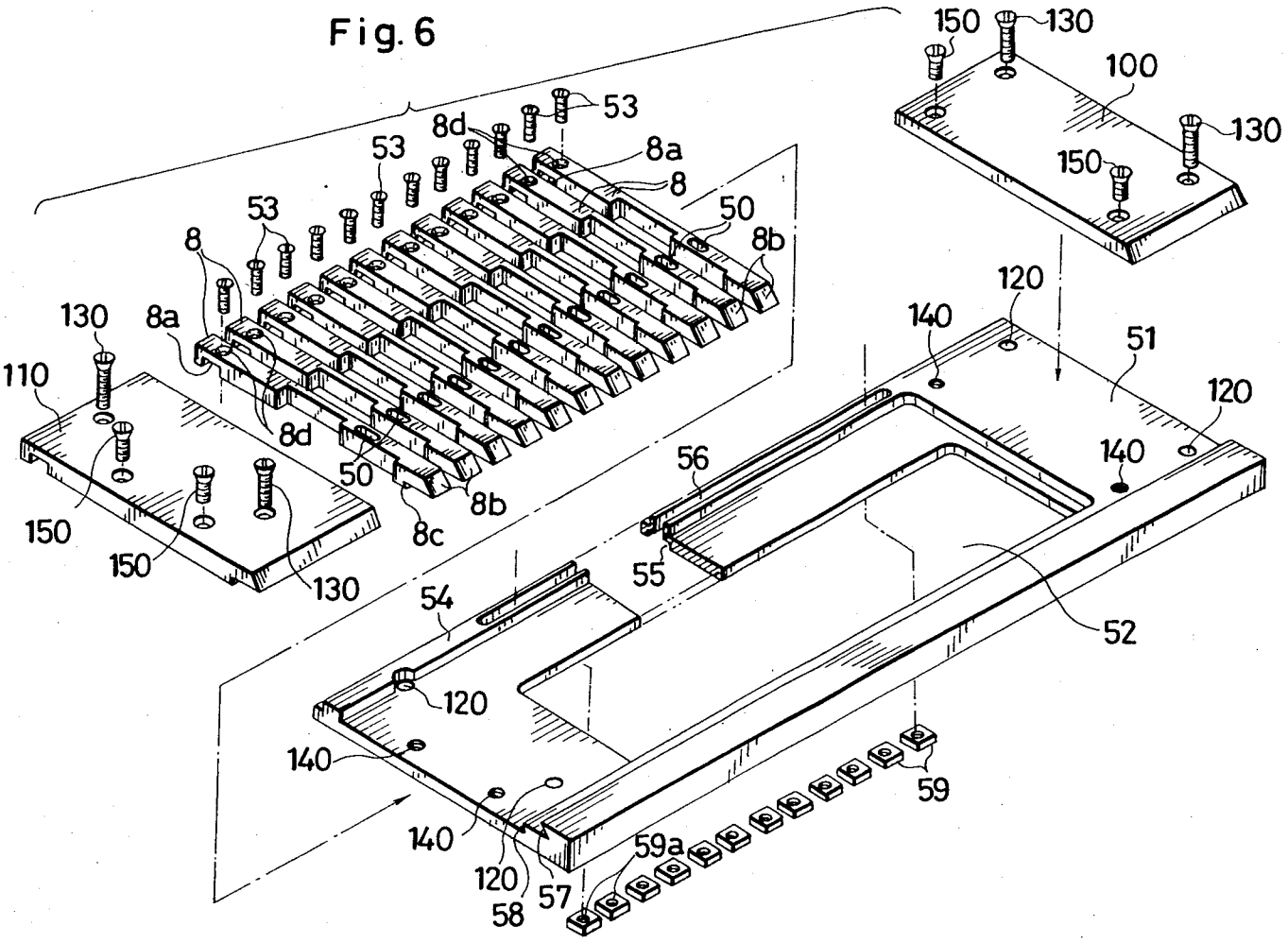
FIG. 6 is an exploded perspective view of the same throat plate unit as FIG. 5.

As illustrated in FIGS. 5 and 6, in the throat plate unit 7, a plurality of throat plates 8 is held on a rectangular throat plate holder 51 along the longitudinal direction of said throat plate holder 51 which extends along the direction of the row of needles.

A rectangular hole 52 extending in the longitudinal direction of the throat plate holder 51 is formed in the center of the holder 51, a first groove 57 and a second groove 58 are formed on the front edge portion of the holder 51, both of said grooves 57, 58 forming a wedge-shaped grooves and being slightly stepped in both longitudinal and vertical direction, and a projecting portion 54 extending along the longitudinal direction of the throat plate holder 51 is formed on the rear edge portion of the throat plate holder 51. Through holes 120, 120 and tapped holes 140, 140 are respectively formed on both sides in the longitudinal direction of the throat plate holder 51, and a first side cover 100 and a second side cover 110 are mounted on the holder 51 by set screws 150 screwed into each tapped hole 140. The throat plate holder 51, i.e., the throat plate unit 7 is mounted on the machine body (not illustrated) by inserting each set screw 130 which is once inserted in said first and second side covers 100, 110 in each through hole 120 and by fixedly screwed in the machine body. The upper side of one end in the longitudinal direction of the throat holder 51 is communicated with the upper side of the projecting portion 54 and with the upper side of the second groove 58 in the vicinity of the end portion in the direction of the hole 52.

In each throat plate 8, each eye 50 for needle is formed in the center thereof so that each needle 2 may pass therethrough, a first engaging portion 8*b* and a second engaging portion 8*c* each being wedge-shaped are formed on the front end portion of the throat plate 8 for engagement with the first and second grooves 57, 58 respectively, and a recess 8*a* is formed on the rear end portion of the throat plate 8 for engagement with the projecting portion 54 of the holder 51. Said first and second engaging portions 8*b*, 8*c* are respectively engaged with the first and second grooves 57, 58 from one side in the longitudinal direction of the throat holder 51 and the recess 8*a* is engaged with the projecting portion 54, thereby each throat plate 8 being held on the holder 51 in a manner slidable along the direction parallel with the row of needles.

Each throat plate 8 is fixed to the throat plate holder 51 by a needle fixing means. More particularly a recessed groove 55 is formed on the lower side of the throat plate holder 51 facing to the projecting portion 54 and extending therealong and a lengthwise hole 56 extending along the projecting portion 54 and passing through to or communicating with the recessed groove 55. Each throat plate 8 is fixed to any slided position by inserting each set screw 53 which is once inserted in each through hole 8*d* provided on the rear end portion of each throat plate 8 in said lengthwise hole 56, and by tightening said set screw 53 after being screwed in each tapped hole 59*a* of each rectangular nut member 59 which is slidably but not rotatably engaged with the recessed groove 55.

Figure 7:
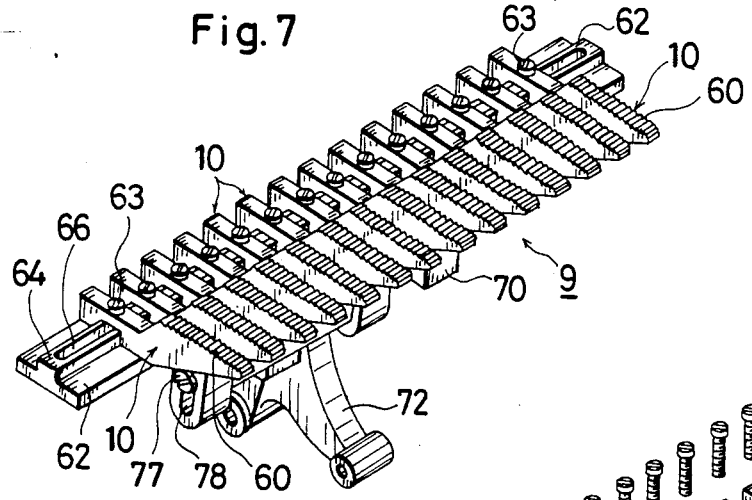
FIG. 7 is a perspective view of a feed dog unit in the same embodiment.
Figure 8:
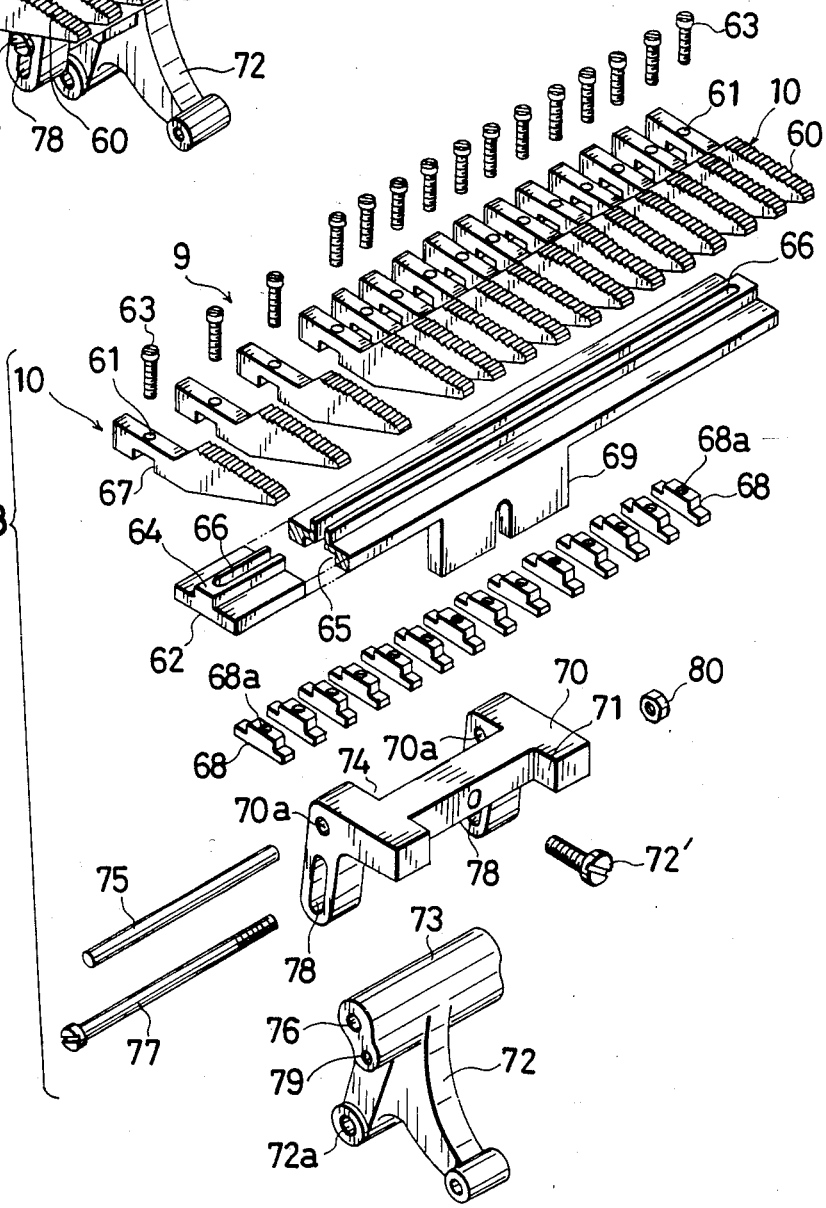
FIG. 8 is an exploded perspective view of the same feed dog unit as FIG. 7.

As shown in FIGS. 7 and 8, in the feed dog unit 9, a plurality of feed dogs 10 on the front upper side of which each sawtooth-shaped feeding part 60 is formed are held on the rectangular feed dog holder 62 being arranged in a row along the longitudinal direction of the holder 62 which extends along the direction parallel with the row of needles. A projecting part 64 extending along the longitudinal direction of the feed dog holder 62 is provided on the upper side of the holder 62, and by engaging the recess 67 formed on the rear lower side of each feed dog 10 with said projecting portion 64, each feed dog 10 is held on the holder 62 in a manner slidable along the direction parallel with the row of needles.

Each feed dog is fixed to the feed dog holder 62 by a feed dog fixing means. More particularly, a recessed groove 65 facing to the projecting groove 65 and extending therealong is formed on the lower side of the feed dog holder 62, and a lengthwise hole 66 passing through to the recessed groove 65 and extending along the projecting portion 64 is formed. Thus by inserting each set screw 63 inserted through each through hole 61 formed on the rear end portion of each feed dog 9 and by tightening the screw 63 after being screwed in the each tapped hole 68*a* of each nut member 68 which is slidably but not rotatably engaged with the recessed groove 65, each feed dog 10 is fixed to any slided position. Furthermore, a rectangular projecting portion 69 is vertically provided in the center of the front edge portion of the feed dog holder 62, and the holder 62 is fixed to a bracket 70 by engaging said projecting portion 69 with the bracket 70 and by tightening a screw 72'.

Said bracket 70 is mounted on an arm 72 to be connected with a feed dog drive unit (not illustrated). More particularly a projecting portion 73 formed on the upper part of the arm 72 is engaged with an engaging portion 74 formed on the bracket 70, a pin 75 is inserted, in each hole 70*a*, 70*a* and a hole 76 of said projecting portion 73, and a screw 77 is inserted in each slot 78, 78 formed on both lower end portion of the bracket 70 and a hole 79 formed on the projecting portion 73 of the arm 72 to be fixed by a nut 80. The lower end portion of the arm 72 is a center of turning, and therefore a shaft (not illustrated) provided on the machine body is inserted in a hole 72*a*. Each feed dog 9 performs a reciprocating motion back and forth by connecting the right side portion of the arm 72 with the feed dog drive unit of the machine body.

Figure 9:
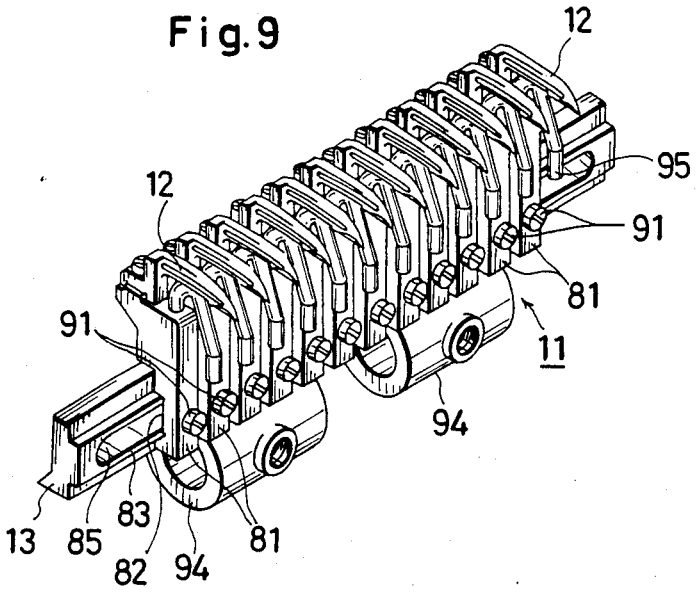
FIG. 9 is a perspective view of a looper unit in the same embodiment.
Figure 10:
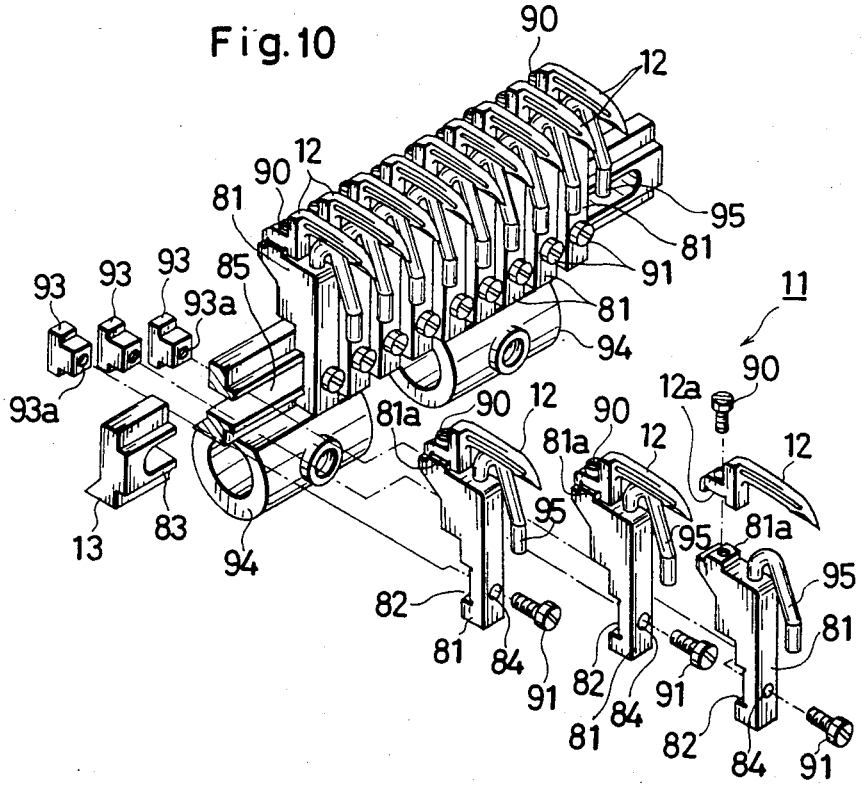
FIG. 10 is a partially exploded perspective view of the same looper unit as FIG. 9.

As shown in FIGS. 9 and 10, in the looper unit 11, a plurality of loopers 12 each mounted on each looper retaining member 81 are held on a rectangular looper holder 13 along the longitudinal direction of the holder 13 which extends along the direction of the row of needles. A recess 12*a* is formed on the rear lower side of each looper 12, and a projecting portion 81*a* is formed on the rear upper side of each looper retaining member 81. Each looper 12 is mounted on each looper retaining member 81 by engaging the projecting portion 81*a* with the recess portion 12*a* and by tightening the set screw 90 screwed in the projecting portion 81*a*. A needle guard bar 95 for preventing a needle from deviating or vibrating when the looper 12 takes up a thread and which is located under the looper 12 is mounted on the upper side of each looper retaining member 81. A projecting portion 83 extending in the longitudinal direction of the looper holder 13 is formed on the front portion of the holder 13, and by engaging said projecting portion 83 with a recess 82 formed on the rear lower side of each looper retaining member 81, each looper 12 is held on the looper holder 13 in a manner slidable along the direction parallel with the row of needles.

Each looper retaining member 81 is fixed to the looper holder 13 by a looper fixing means. More particularly a lengthwise hole 85 locating in the center of the projecting portion 83, extending along the longitudinal direction of the projecting portion 83 and passing through the projecting portion in the transversal direction is formed on the looper holder 13, and by inserting a set screw 91 which is inserted in the through hole 84 formed on the lower portion of each looper retaining member 81 into said lengthwise hole 85 and by tightening the screw 91 after being screwed in the tapped hole 93*a* of a nut member 93 which is slidably but not rotatably inserted into the lengthwise hole 85 from the back side of the holder 13, each looper is fixed to any slided position. Further, shaft fitting members 94, 94 for fitting a shaft of looper drive unit (not illustrated) are provided on the lower side of the looper holder 13.

By the above-described construction, when changing or adjusting the needle interval, at the stage of the needle unti 1, the set screw 27 is loosened, the needle holder 20 is shifted to the position where a required needle interval is obtained, and the set screw 27 is tightened.

Then, at the stage of the presser foot unit 5, the screw 44 fixing the presser foot 6 is loosened, each presser foot 6 is slided or shifted corresponding to the needle interval of the needles 2, and the screw 44 is tightened to fix again each presser foot 6.

Nextly, at the stage of the throat plate unit 7, the screw 53 on each throat plate 8 is loosened, the throat plate 8 is shifted corresponding to the needle interval of the needles 2, and the screw 53 is tightened to fix again each throat plate 8.

Nextly, at the stage of the feed dog unit 9, the screw 63 fixing the feed dog 10 is loosened, the feed dog 10 is shifted corresponding to the needle interval of the needles 2, and the screw 63 is tightened to fix again each feed dog to the feed dog holder 62.

Finally, at the stage of the looper unit 11, the screw 91 fixing the looper retaining member 81 is loosened, the looper retaining member 81 is shifted along the lengthwise hole 85, and the screw 91 is tightened to fix again each looper 12 to the looper holder 13.

Furthermore, to still further achieve the objects of the present invention which is to be able to change the relative positions of the throat plates 8 and the feed dogs 10, each throat plate 8 should be designed to be a minimum necessary shape sufficient to form a needle eye thereon and as a result each individual throat plate 8 may provide a gauging function when setting the relative position and distribution of the throat p1ates 8. A similar situation exists for the feed dogs 10.

Figure 14:
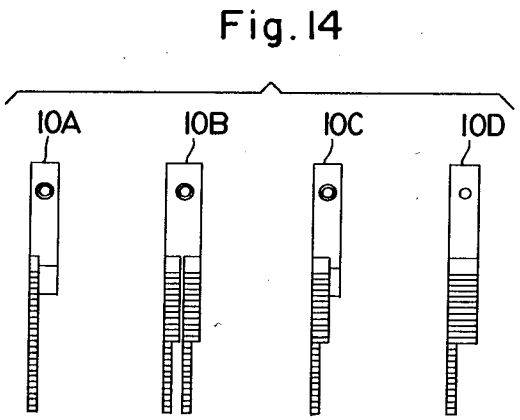
FIG. 14 is an illustration of different feed dogs which are utilized together with the plurality of different throat plates of FIG. 13 to achieve the objects of the present invention.
Figure 13:
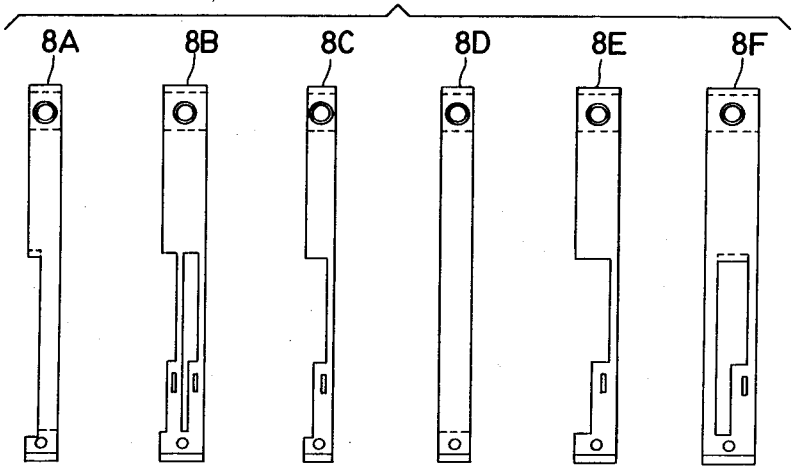
FIG. 13 illustrates a plurality of different throat plates utilized to achieve the objects of Applicant's invention.

To provide the minimum necessary shape for the throat plates 8 and the feed dogs 10, a plurality of different throat plates 8 and feed dogs 10 can be utilized. Examples of such different throat plates are illustrated in FIG. 13 and comprise the different shaped throat plates 8A–8F which can also be different widths. The different shaped feed dogs which can be of different widths are illustrated in FIG. 14 and examples of such feed dogs are the feed dogs 10A–10D.

Figure 15C:
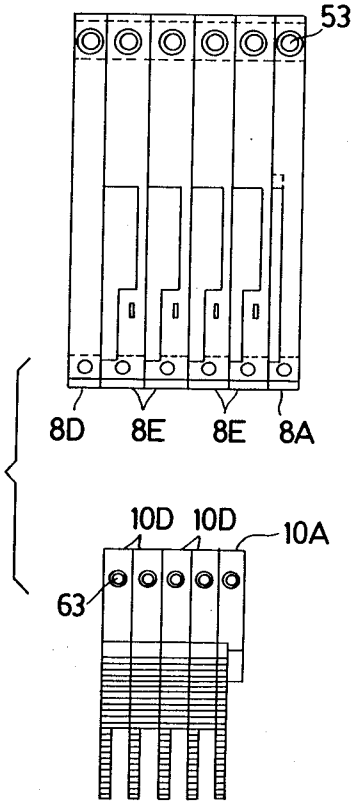
FIGS. 15(A), 15(B), 15(C), 15(D), 15(E), 15(F), 15(G), 15(H), 15(I), 15(J) and 15(K) are simplified drawings illustrating the various ways in which the throat plates of FIG. 13 and the feed dogs of FIG. 14 can be arranged and cooperate together to achieve the objects of the present invention.
Figure 15B:
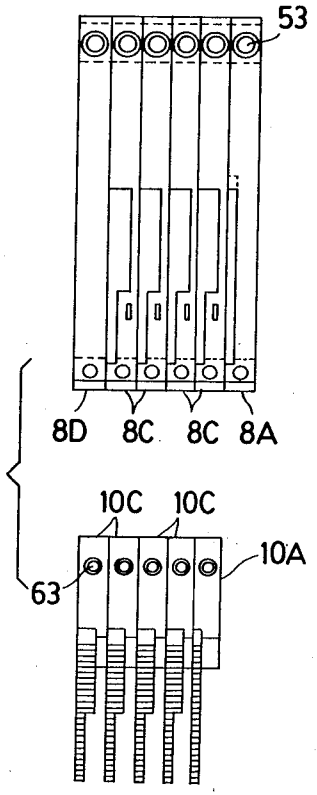
Figure 15A:
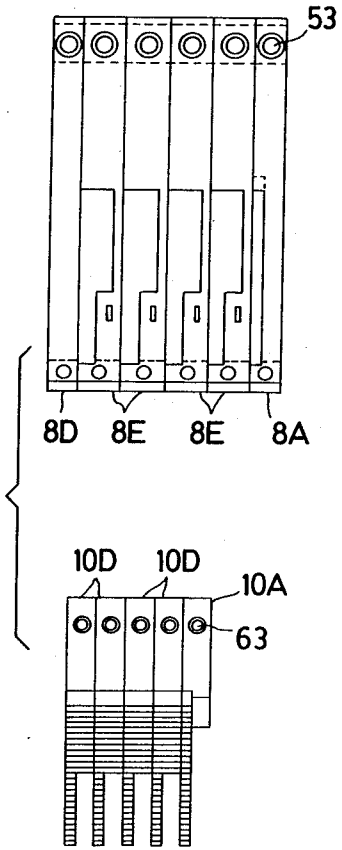
Figure 15F:
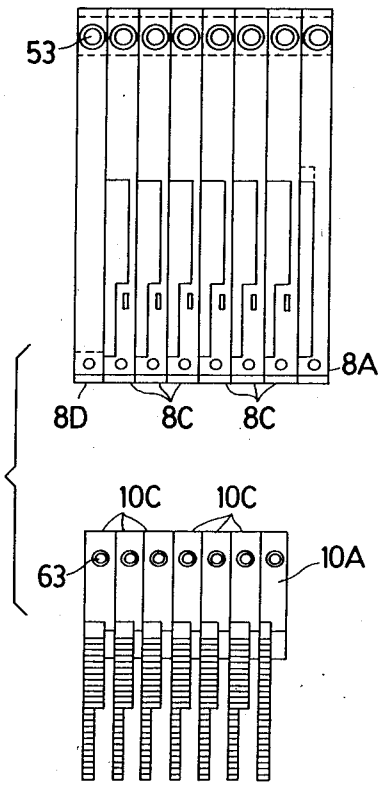
Figure 15E:
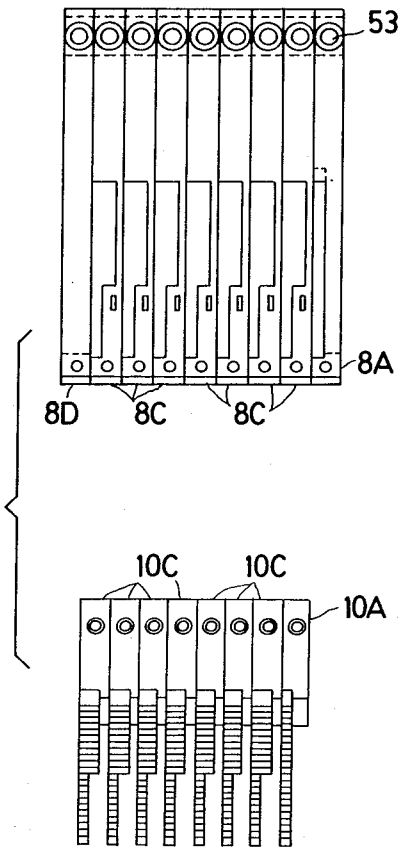
Figure 15D:
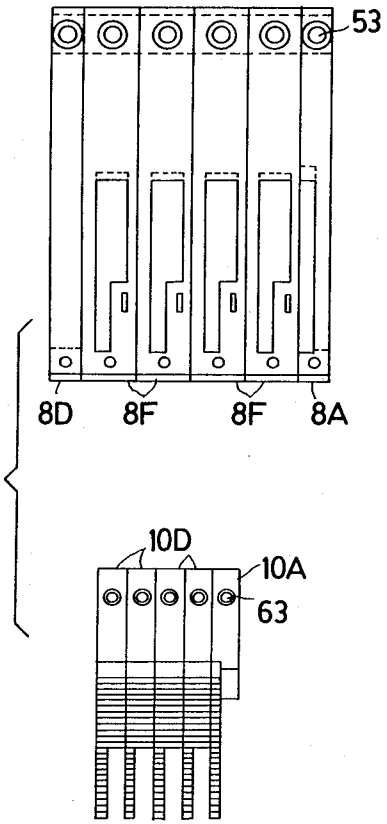
Figure 15I:
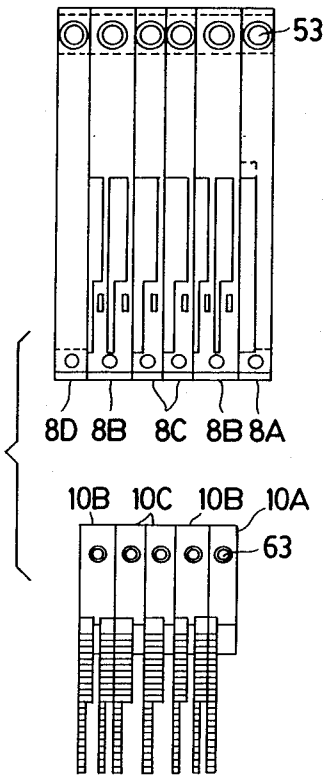
Figure 15H:
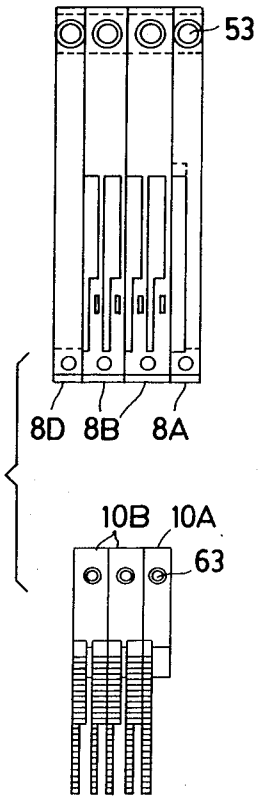
Figure 15G:
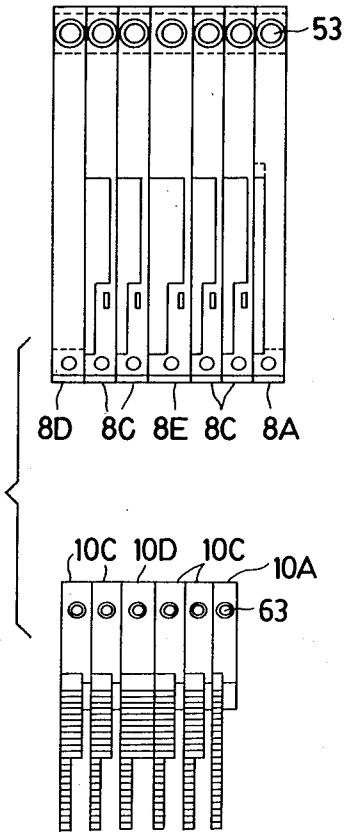
Figure 15K:
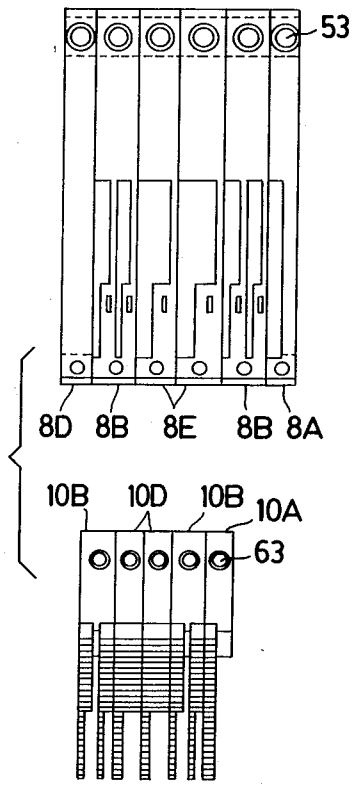
Figure 15J:
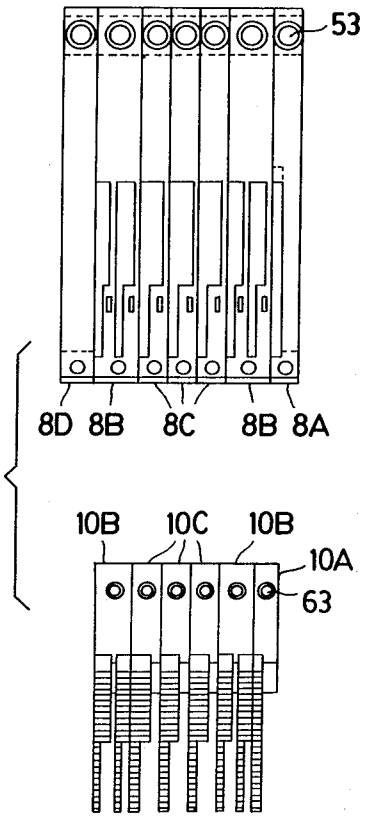

Referring now particularly to FIGS. 15(A)–15(K), shown therein are various combinations of the throat plates 8A–8F and an associated combination of feed dogs 10A–10D. Utilizing these various combinations and configurations, the relative position and configuration of the feed dogs 10 and throat plates together, the gauging function can be achieved so that the intervals between the needles can be greatly varied and can be adjusted to achieve any desired result. In addition, the numbers which appear in brackets above the combinations of the throat plates in each of the FIGS. 15(A-)–15(K) are indicative of the spacings provided by the gauging function of the different throat plates 8A–8F and the feed dogs 10A–10D. In particular and by way of example, the number 1 in FIG. 15(A) means that the spacing is at an equal distance of one inch, the numbers 3/16-$\frac{7}{8}$-3/16 which appear in FIG. 15(K) mean that the lateral distance is $\frac{7}{8}$ of an inch at the center and 3/16 of an inch at both sides and the numbers $\frac{1}{4}$–$\frac{7}{8}$–$\frac{1}{4}$, $\frac{1}{4}$–$\frac{3}{4}$–$\frac{1}{4}$ which appear in FIG. 15(F) mean that two different distances are established by the gauging function and these distances are a laterial distance of $\frac{7}{8}$ of an inch at the center and $\frac{1}{4}$ of an inch at both sides and a lateral distance of $\frac{3}{4}$ of an inch at the center and $\frac{1}{4}$ of an inch at both sides. This last spacing of FIG. 15(F) illustrates the versatility and variability of the present invention.

Each construction or formation of the needle unit 1, the presser foot unit 5, the throat plate unit 7, the feed dog unit 9 and the looper unit 11 is as above-described, but it is merely an illustrative embodiment of this invention, and such construction is also possible wherein a spacer is provided so as to obtain each interval corresponding to the fixed needle interval among each needle holder 20, 20 in the needle unit 1, among each presser 6, 6 in the presser foot unit 5, among each throat plate 8 8 in the throat plate unit 7, among each feed dog 10, 10 in the feed dog unit 9, and among each looper retaining member 81, 81 in the looper holder 13, and therefore all changes and modifications of the foregoing embodiments of the invention herein do not constitute departures from the spirit and scope of the inventions.

Thus, in the preceding first embodiment, the locus of looper 12 in relation to the locus of the needle 2 constitutes a movement of looper whereby a double chain stitch is achieved. However, in case of a looper of which locus shows a reciprocating motion back and forth, as the reciprocating motion is performed between the throat plate 8 and the looper 12, it is necessary to provide a known spreader so that the upper thread on the needle 2 may be passed through a loop of the under thread on the looper 12 to form seams of the double chain stitch. Accordingly, it is also possible to provide a spreader unit of which spreader position is adjustable corresponding to the needle interval.

Then an embodiment of the sewing device with the spreader unit is described in detail hereunder. In this embodiment, the like parts such as needle unit, presser foot unit, throat plate unit, feed dog unit, looper unit are designated the same reference numerals as the preceding first embodiment.

Figure 11:
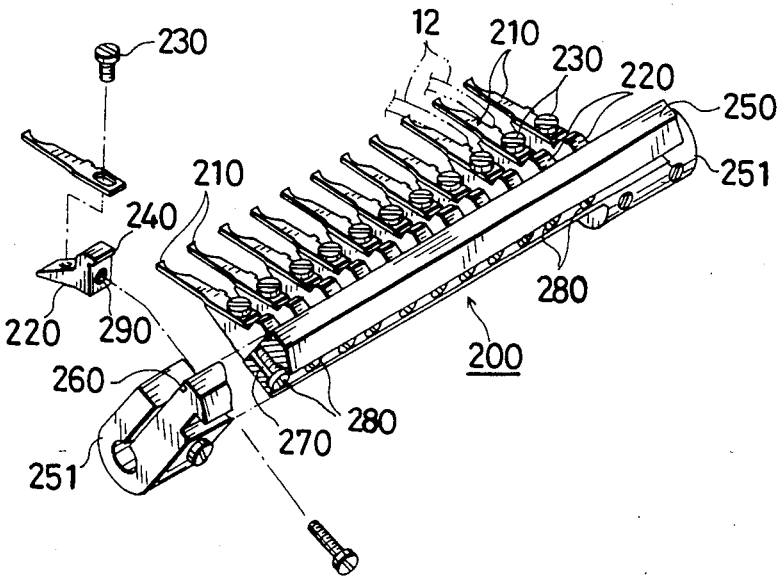
FIG. 11 is a partially exploded perspective view of a a spreader unit illustrating another embodiment of this invention.
Figure 12:
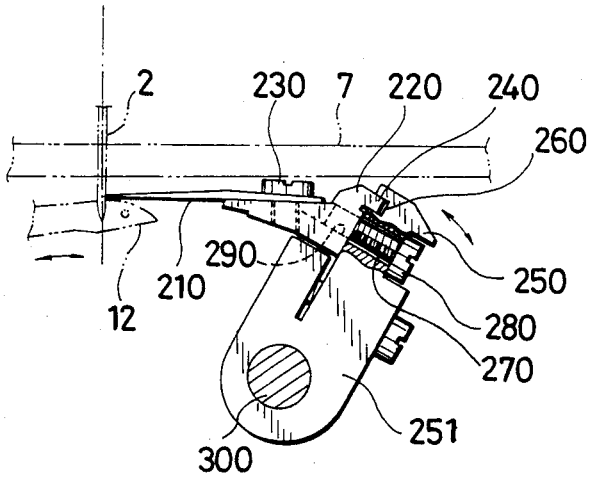
FIG. 12 is a partially cutaway view of the same spreader unit.

In the spreader unit 200, as shown in FIGS. 11 and 12, a plurality of spreaders 210 mounted respectively on each spreader retaining member 220 by means of each screw 230 are held on the spreader holder 250 along the longitudinal direction of the holder 250 extending in the direction parallel with the row of needles. A recess 260 extending in the longitudinal direction of the spreader holder 250 is formed on the back side of the holder 250, and by engaging a projecting portion 240 formed on each spreader retaining member 220 with said recess 260, each spreader 210 is held on the spreader holder 250 in a manner slidable along the direction parallel with the row of needles.

Each spreader 210 is fixed to the spreader holder 250 by a spreader fixing means. More particularly a lengthwise hole 270 extending in the longitudinal direction of the spreader holder 250 is formed on the holder 250, and by tightening each set screw 280 after being screwed in the tapped hole 290 formed on the spreader retaining member 220, each spreader 210 is fixed to any slided position. Furthermore, shaft fitting members 251, 251 for fitting a shaft 300 of the spreader drive unit are provided on both sides in the longitudinal direction of the spreader holder 250. Thus, by means of the spreader drive unit, every spreader 210 performs a reciprocating motion so as to carry out the double chain stitch corresponding to the motion of the loopers 12 and the vertical motion of the needles 2.

In aforesaid sewing machine with spreader unit 200, each spreader 210 is fixed to said position by loosening each screw 280, sliding or shifting each spreader 210 to the position corresponding to the changed needle interval, and tightening each set screw 280. By said operation the interval among respective spreaders can be set adapting to the needle interval.

What is claimed is:

1. A sewing device for use in multi-needle sewing machines comprising:

a needle unit with a plurality of needles arranged in a row, in which a needle holder for each of said plurality of needles is supported on a needle bed in a manner slidable in a direction parallel with the row of needls and in which means for fixing each needle holder to any slided position is provided;

a presser foot unit with a plurality of presser feet, in which each of said presser feet is held on a presser foot holder in a manner slidable in a direction parallel with the row of needles in which means for fixing each presser foot to any slided position is provided;

a throat plate unit with a plurality of throat plates of at least one type and width, in which each of said throat plates is held on a throat plate holder in a manner slidable in the direction parallel with the row of needles and in which means for fixing each throat plate to any slided position is provided;

a feed dog unit with a plurality of feed dogs of at least one type and width, in which each of said feed dogs is held on a feed dog holder in a manner slidable in the direction parallel with the row of needles and in which means for fixing each feed dog to any slided position is provided; and a looper unit with a plurality of loopers, in which each of said loopers is held on a looper holder in a manner slidable in the direction parallel with the row of needles and in which means for fixing each looper to any slided position is provided;

whereby the interval between the needles of the needle unit, the presser feet of the presser foot unit, the throat plates of the throat plate unit, the feed dogs of the feed dog unit and the loopers of the looper unit can be adjusted and varied.

2. A sewing device for use in multi-needle sewing machines according to claim 1, wherein a spreader unit with a plurality of spreaders is provided in which each spreader is held on a spreader holder in a manner slidable in the direction parallel with the row of needles and in which means for fixing each spreader to any slided position are provided.

3. A sewing device for use in multi-needle sewing machines according to claim 1, wherein said means for fixing each needle holder comprises a lengthwise hole formed on the needle bed and extending in the direction parallel with the row of needles and a plurality of set screws which are inserted in said lengthwise hole and screwed into each needle holder, and by tightening said set screws each needle holder is fixed to the needle bed.

4. A sewing device for use in multi-needle sewing machines according to claim 1, wherein said means for fixing each presser foot comprises a plurality of set screws which are each screwed into a presser foot mounted slidably on a rod extending along the direction parallel with the row of needles, and by tightening said screws so as to be pressed on the rod each presser foot is fixed to the presser foot holder.

5. A sewing device for use in multi-needle sewing machines according to claim 1, wherein said means for fixing each throat plate comprises a lengthwise hole formed on the throat plate holder and extending in a direction parallel with the row of needles and a plurality of set screws which are inserted in said lengthwise hole after passing through each throat plate and screwed onto a nut member, and by tightening said set screws each throat plate is fixed to the throat plate holder.

6. A sewing device for use in multi-needle sewing machines according to claim 1, wherein said means for fixing each feed dog comprises a lengthwise hole formed on the feed dog holder and extending in a direction parallel with the row of needles and a plurality of set screws which are inserted in said lengthwise hole after passing through each feed dog onto a nut member, and by tightening said set screws each feed dog is fixed to said feed dog holder.

7. A sewing device for use in multi-needle sewing machines according to claim 1, wherein a looper is mounted on a looper retaining member.

8. A sewing device for use in multi-needle sewing machines according to claim 7, wherein said means for fixing each looper comprises a lengthwise hole formed on the looper holder and extending in a direction parallel with the row of needles and a plurality of set screws which are inserted in said lengthwise hole after passing through each looper retaining member and screwed into a nut member, and by tightening said set screw each looper is fixed to the looper holder.

9. A sewing device for use in multi-needle sewing machines according to claim 2, wherein each spreader is mounted on a spreader retaining member.

10. A sewing device for use in multi-needle sewing machings according to claim 9, wherein said means for fixing each spreader comprises a lengthwise hole formed on the spreader holder and extending in a direction parallel with the row of needles and a plurality of set screws which are inserted in said lengthwise hole and screwed in each spreader retaining member, and by tightening said set screws each spreader is fixed to the spreader holder.

11. A sewing device for use in multi-needle sewing machines according to claim 1, wherein at least two different types of throat plates with at least two different widths are utilized in said throat plate unit.

12. A sewing device for use in multi-needle sewing machines according to claim 11, wherein at least two different types of feed dogs of at least two different widths are utilized in the feed dog unit.

* * * * *